United States Patent [19]

Poliak et al.

[11] 4,060,305

[45] Nov. 29, 1977

[54] LOOP FORMING GAUGE AND METHOD OF FORMING A LOOP

[75] Inventors: John M. Poliak, East Meadow; Juan M. Lopez; Robert W. Gritz, both of New York, all of N.Y.

[73] Assignee: Leviton Manufacturing Co., Inc., Little Neck, N.Y.

[21] Appl. No.: 682,082

[22] Filed: Apr. 30, 1976

[51] Int. Cl.[2] ..... H01R 9/10; H01R 43/00

[52] U.S. Cl. ..... 339/269; 7/1 R; 29/630 A; 29/745; 29/758

[58] Field of Search ..... 29/628, 630 A, 630 F, 29/745, 758; 81/9.5, 9.51; 140/104, 106; 7/1 R; 339/263, 269, 271, 198 R, 198 E

[56] References Cited

U.S. PATENT DOCUMENTS

| | | | |
|---|---|---|---|
| 1,815,233 | 7/1931 | Burke | 339/198 E |
| 2,694,800 | 11/1954 | Sunderhauf | 339/269 |
| 2,735,080 | 2/1956 | Littman | 339/269 |
| 2,973,503 | 2/1961 | Hansen | 339/269 |
| 3,124,021 | 3/1964 | Benander | 81/9.5 C |
| 3,253,286 | 5/1966 | Bacon | 81/9.5 C |

FOREIGN PATENT DOCUMENTS

| | | | |
|---|---|---|---|
| 673,907 | 6/1952 | United Kingdom | 339/269 |

*Primary Examiner*—Roy Lake

*Assistant Examiner*—Neil Abrams

*Attorney, Agent, or Firm*—Paul J. Sutton

[57] ABSTRACT

An electrical wiring device is provided combining a strip gauge, a loop forming gauge and a wire-restraint which are coordinated to form a loop in a bare end of a solid insulated conductor wire at a location where insulation on the wire extends into the wire-restraint when the loop is secured under a terminal binding screw. The stripping gauge comprises a marking molded on the device and indicating the length of insulation to be removed from the wire prior to forming the loop in the bare end of the wire. The loop-forming gauge comprises side walls defining a cavity in the body of the device and a rounded shoulder formed at an upper end of said cavity. The bare end of the wire is confined within the cavity while the bare end of the wire is bent over the rounded shoulder into the form of the loop in the wire. The wiring device also includes wire-restraints which engage with insulation on the wire when the loop is secured under the binding screw.

The method disclosed involves measuring and stripping insulation from the end of an insulated conductor wire. Then bending the stripped bare end of the wire into a loop at a location where insulation on the wire extends into the wire-restraint when the loop is secured under a binding screw carried by a terminal plate.

5 Claims, 4 Drawing Figures

LOOP FORMING GAUGE AND METHOD OF FORMING A LOOP

FIELD OF THE INVENTION

The present invention relates to an electrical wiring device having a terminal screw and incorporating a stripping gauge, a loop-forming gauge and a wire-restraint each of which functions in coordination with the other. It also relates to a method of forming a loop at a predetermined location in a bare end of an insulated electrical conductor wire.

The invention relates, more paricularly, to an electrical wiring device having a terminal plate carrying a binding screw which combines a strip gauge, and a gauge for forming a loop in a bare end of an insulated conductor wire for engagement with the binding screw and a wire-restraint engaging with insulation on the wire when the loop in wire is held under the binding screw.

The invention also relates to a method of forming a loop in a bare end of an insulated conductor wire at a location where insulation on the wire extends into a wire-restaint when said loop is in engagement with a binding screw.

DESCRIPTION OF THE PRIOR ART

It has been customary to provide a strip gauge on an electrical wiring device to indicate the length of insulation which is removed from an insulated conductor wire for purpose of connecting the wire to a terminal screw or the like. In accordance with applicants' invention, provision is made to form a loop in the bare end of wire at a location coordinated lengthwise so that a wire-restraint on the device enters into engagement with insulation on the wire when the looped bare end thereof is secured to a binding screw.

OBJECTS AND SUMMARY OF THE INVENTION

An object of the present invention is to provide an electrical wiring device with a gauge for correctly forming a loop in a bare end of a conductor wire which is electrically secured in place under a terminal screw and with insulation on the wire extending into a wire-restraint passageway.

An object of the present invention is to provide an electrical wiring device combining a strip gauge and a loop-forming gauge dimensioned to insure that insulation adjoining a bare end of an insulated conductor wire enters a wire-restaint when a loop formed in a bare end of the wire is secured to a binding screw terminal.

A further object of the invention is to provide a simple and effective procedure for forming a loop of proper dimension and size in a bare end of an insulated electrical conductor wire.

Other advantages and objects of the invention will be better understood from the following description and the accompanying drawing.

DETAILED DESCRIPTION OF THE DRAWING

Figure 1:
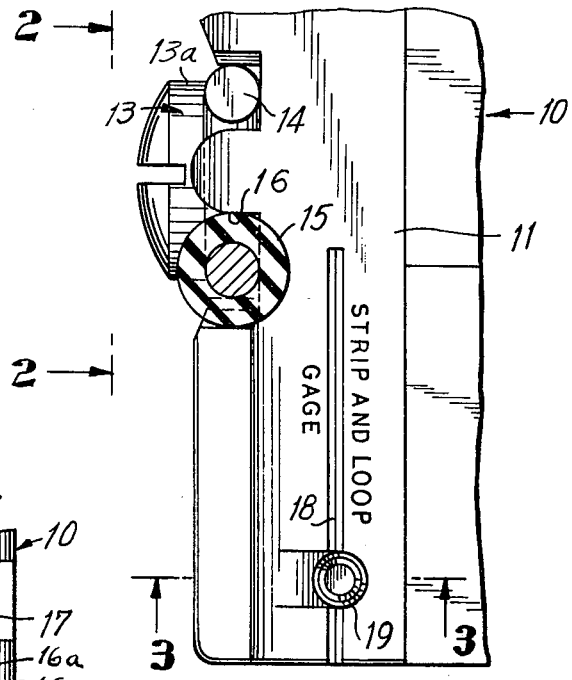
FIG. 1 is a fragmentary bottom view of one end of an electrical wiring device embodying the present invention with a looped bare end of an insulated conductor wire attached to a binding screw thereof.

Referring now to FIG. 1, there is an end portion of a wiring device 10 having a rigid base 11 molded of plastic insulating material. The wiring device 10 may be of conventional contruction and hence, need not be described in detail here.

Figure 2:
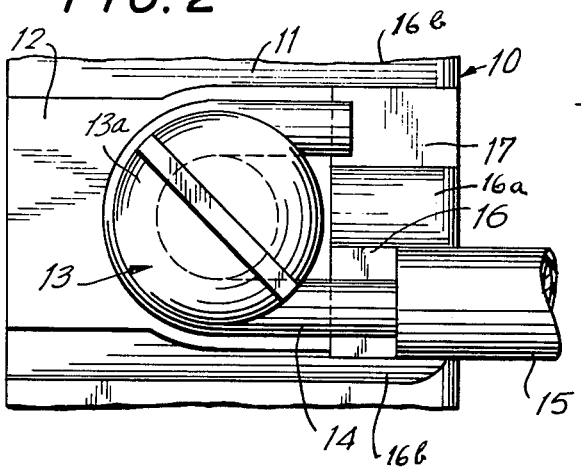
FIG. 2 is a fragmentary side view of the wiring device shown in FIG. 1 as seen from lines 2—2.

A terminal plate 12 of conductive material extends along one side of the wiring device 10 and carries a headed terminal screw 13. The screw 13 threadably engages with the plate 12 for movement of a head **13*a* thereof toward and away from the plate 12. As shown in FIGS. 1 & 2, a bare end 14 of an insulated conductor wire 15 is looped around the terminal screw 13 and is secured against the terminal plate 12 by the head 13*a* of the screw 13 which holds the wire in electrical contact with the plate 12. The particular wire 15** illustrated is a solid type of wire.

In order to establish good electrical contact between the looped bare end 14 of the wire 15 and the plate 12, the looped end 14 should rest flat against the terminal plate 12 and the loop should extend approximately three-quarters of a turn around the screw 13, in a clockwise direction (for a right hand screw). As shown in FIGS. 1 & 2, the conductor wire 15 enters a wire-restraint 16 at one end of the device 10 while the free end extends rearwardly into a second wire-restraint 17 which extends parallel the restraint 16. As shown in FIG. 2, the insulation on the entering of the end of the conductor wire 15 extends into the restraint 16 for a short distance when the bare end 14 is looped around the binding screw 13. This requires that the loop in the end 14 be formed at a proper distance from the end of the wire. The restraint passgeways 16 and 17 are formed by a central rib **16*a* with side ribs 16*b* extending along opposite sides of the base 11**.

As shown in FIG. 1, a strip gauge 18 is molded in the base 11 of the device 10. The strip gauge 18 determines the proper length of the wire 15 from which the insulation is removed to expose the bare end 14 of the wire in which the loop is formed. The insulation is removed by cutting or slicing through the insulation and sliding the severed insulation from the bare end 14 of the wire 15.

Figure 3:
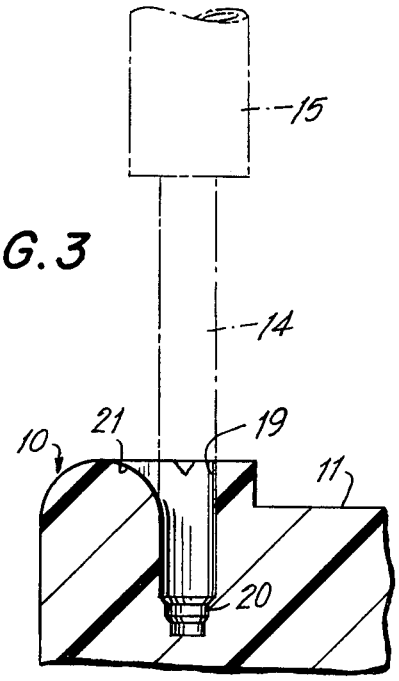
FIG. 3 is a fragmentary view in vertical section taken along line 3—3 of FIG. 2 with a bare end of a conductor wire, as shown by dot and dash lines, inserted into loop forming position.

Once the insulation is removed to expose the bare end 14 of the wire, a loop is then formed therein. The loop is formed by inserting the bare end 14 of the wire 15 vertically, as shown in FIG. 3, into a cavity 19 and seating the end of the wire at a base or bottom 20 of the cavity 19. As shown, the bottom 20 of the cavity 19 is stepped to receive wires of different sizes namely, #10 AWG, #12 AWG or #14 AWG. As shown, the end of the #10 wire will be seated on the first step, the end of the #12 wire (not shown) will be seated on the second step, and the end of the #14 wire (not shown) will be seated on the third or last step.

Figure 4:
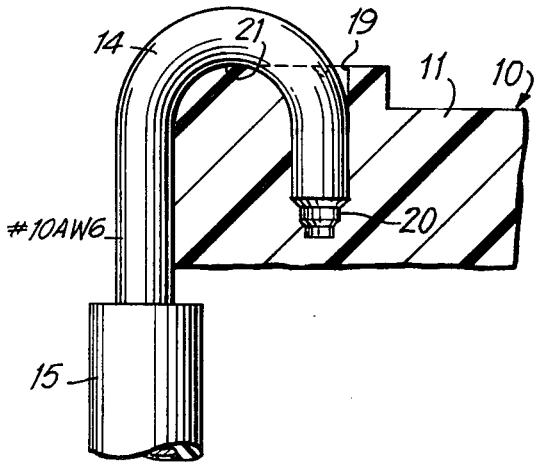
FIG. 4 is a fragmentary view corresponding to FIG. 3 after a loop has been formed in the bare end of the conductor wire.

After the bare end 14 of the wire has been inserted in the cavity 19 and the end is seated at the bottom 20 thereof, the bare end 14 of the wire which is held or confined by the side walls of the cavity 19 and is then bent at a location intermediate its length over a rounded shoulder 21 formed at an upper end of one of the side walls defining the cavity 19 to a looped configuration as shown in FIG. 4. This procedure forms a loop in the bare end 14 of the conductor wire at a location where insulation on the wire 15 enters into the wire-restraint 16 when the loop extends around and is secured under the terminal screw 13.

More specifically, the cavity 19 has a diameter of 0.109 inch and a depth of 0.285 inch for #10 AWG wire. The diameter at the bottom of the cavity decreases to 0.88 inch and the overall depth of the cavity increases to 0.325 inch for the #12 wire. At the third step, the diameter of the cavity decreases to 0.72 inch and the depth increases to 0.365 inch for the #14 AWG wire. The stepped down dimensions at the bottom of the cavity 19 permit the cavity to accomodate three different sizes of wire. In each case, the insulation on the wire 15 will enter into and be protected by the wire-restraint 16.

SUMMARY

Briefly, the present invention relates to an electrical wiring device which incorporates both a loop forming gauge, a stripping gauge and a wire-restaint. The stripping gauge determines the length of wire from which insulation is to be removed and also, the location in the bare end of the wire where the loop is formed by the loop forming gauge. The loop forming gauge forms the loop in a bare end of a solid wire which fits snugly around a binding screw and under a headed end of the screw for convenient use in electrically attaching the bare end of the wire to the wiring device with the insulation on the wire extending into the wire-restraint.

The loop in the bare end of the wire can be readily and accurately formed by unskilled persons and without the use of tools.

It will be understood that various changes and modifications may be made by those skilled in the art in the embodiment of the invention illustrated and described herein without departing from the spirit or scope of the invention.

What is claimed is:

1. In an electrical wiring device, the improvement comprising: a base of rigid insulating material; a terminal plate mounted on said base; a binding screw threadably carried by said plate; wire-restraints formed on said base in spaced relation to said binding screw; said wire-restraints including projections defining open passageways communicating with opposite sides of said binding screw; a strip gauge formed on said base for measuring a length of insulated conductor wire for removal of insulation therefrom and a loop forming gauge formed in said base for receiving and bending the said length of conductor wire into a loop for engagement with said binding screw with insulation on the wire extending into one of said wire-restraint passageways, said loop forming gauge comprising a cavity formed within a base of substantially rigid insulating material and of a predetermined configuration; the configuration of said cavity being defined by substantially straight base wall portions communicating with stepped termination portions thereof, said stepped termination portions comprising means for accepting wires of more than one diameter, and a base surface with shoulder portions thereof extending in a substantially arcuate path in communication with said steped termination portions, thereby providing means for guiding and forming an arucate wire configuration.

2. In an electrical wiring device having a binding screw terminal, the combination comprising: a stripping gauge for determining a length of insulation to be removed from an insulated electrical conductor wire and providing a bare end of said wire of a predetermined length; a loop forming gauge for forming a loop in said bare end of said wire, said loop engaging with a terminal screw; and a wire-restraint engaging with an end of the insulation adjoining said bare end of said wire when said loop is in engagement with said binding screw, said loop forming gauge comprising a cavity formed within a base of substantially rigid insulating material and of a predetermined configuration, the configuration of said cavity being defined by substantially straight base wall portions communicating with stepped termination portions thereof, said stepped termination portions comprising means for accepting wires of more than one diameter, and a base surface with shoulder portions thereof extending in a substantially arcuate path in communication with said stepped termination portions, thereby providing means for guiding and forming an arucate wire configuration.

3. In an electrical wiring device having a binding screw terminal and a wire-restraint, the combination comprising: a rigid base of insulating material, having a terminal screw; ribs on said base and forming wire-restraints; means on said base for establishing a length of insulation to be removed from a conductor wire; means for forming a loop in a bare end of said wire; said loop being formed at a point where insulation on said wire extends into one of said wire-restraints when said loop is secured under said binding screw, said loop forming gauge comprising a cavity formed within a base of substantially rigid insulating material and of a predetermined configuration, the configuration of said cavity being defined by substantially straight base wall portions communicating with stepped termination portions thereof, said stepped termination portions comprising means for accepting wires of more than one diameter, and a base surface with shoulder portions thereof extending in a substantially arcuate path in communication with said stepped termination portions, thereby providing means for guiding and forming an arcuate wire configuration.

4. In an electrical wiring device of a type having a binding screw and a wire-restraint, the combination comprising: a rigid base of insulating material; said base having a rear face containing a cavity adopted to receive a bare end of an insulated conductor wire therein; a rounded shoulder formed at an open upper end of said cavity; said shoulder being located at a point relative to said bare end of the wire where insulation on the wire extends into a wire-restraint when said looped end of the wire is secured beneath a terminal screw, said loop forming a gauge comprising a cavity formed within a base of substantially rigid insulating material and of a predetermined configuration, the configuration of said cavity being defined by substantially straight base wall portions communicating with stepped termination portions thereof, said stepped termination portions comprising means for accepting wires of more than one diameter, and a base surface with shoulder portions thereof extending in a substantially arcuate path in communication with said stepped termination portions, thereby providing means for guiding and forming an arcuate wire configuration.

5. The method of forming a loop in a bare end of an insulated conductor wire which comprises the steps of:

placing an insulated conductor wire proximate stripping indices carried by a wiring device, thereby gaining information as to the predetermined extent of insulation to be removed from the conductor wire; removing said predetermined extent of insulation from an end of the conductor wire; inserting the bare end of the conductor wire into one of a plurality of openings within a cavity formed within the wiring device, said cavity being defined by substantially straight base wall portions communicating with stepped termination portions thereof; bending the bare end over a shoulder of arcuately extending portions thereof of a predetermined shape to create a bare end loop corresponding to said predetermined shape at a location of a predetermined distance from the remaining insulation covering said conductor wire while the terminus of the bare end remains in the cavity, attaching the conductor wire to the wiring device by locating a fastener through said bare end loop.

* * * * *